US012653261B2

(12) United States Patent
Johnstone et al.

(10) Patent No.: US 12,653,261 B2
(45) Date of Patent: Jun. 16, 2026

(54) ARTICLE OF HEADGEAR, MOUNTING CLIPS, AND ACCESSORIES

(71) Applicant: JSP Limited, Oxford (GB)

(72) Inventors: Clive Johnstone, Oxford (GB); Steve Sanders, Oxford (GB); Jack Wyld, Oxford (GB)

(73) Assignee: JSP Limited, Oxford (GB)

( * ) Notice: Subject to any disclaimer, the term of this patent is extended or adjusted under 35 U.S.C. 154(b) by 0 days.

(21) Appl. No.: 19/133,215

(22) PCT Filed: Oct. 25, 2023

(86) PCT No.: PCT/GB2023/052790

§ 371 (c)(1),
(2) Date: May 27, 2025

(87) PCT Pub. No.: WO2024/110737

PCT Pub. Date: May 30, 2024

(65) Prior Publication Data

US 2026/0007199 A1 Jan. 8, 2026

(30) Foreign Application Priority Data

Nov. 25, 2022 (GB) ..... 2217708

(51) Int. Cl.
*A42B 3/00* (2006.01)
*A42B 3/04* (2006.01)
*A42B 3/06* (2006.01)

(52) U.S. Cl.
CPC ..... *A42B 3/0406* (2013.01); *A42B 3/06* (2013.01)

(58) Field of Classification Search
CPC ..... A42B 3/0493; A42B 3/065; A42B 3/04; A42B 3/147; A42B 3/202; A42B 3/30
See application file for complete search history.

(56) References Cited

U.S. PATENT DOCUMENTS 4,404,690 A * 9/1983 Farquharson ..... A42B 3/28 2/420
4,434,514 A * 3/1984 Sundahl ..... A42B 3/281 2/181.6

(Continued)

FOREIGN PATENT DOCUMENTS

CN 203986295 U 12/2014
CN 207011778 U 2/2018

(Continued)

*Primary Examiner* — Richale L Quinn
(74) *Attorney, Agent, or Firm* — Dickinson Wright PLLC; Andrew D. Dorisio; Nicholas P. Coleman

(57) ABSTRACT

An article of headgear, such as a safety helmet, comprises a shell (10) with an outer surface having at least one locating notch (14, 16) defining an opening (22). The notch has first and second ends (24, 26), a base, and side walls (30, 32) extending from the base to the outer surface to form a continuous surface with the outer surface of the shell. The width of the opening decreases from one end towards the other. The depth of the side walls increases from one end towards the other. The width of the base decreases from one end towards the other and is wider at the other end than the width of the opening at the other end. The shell has a slot (20) in the outer surface aligned with the end of the notch. A mounting clip (40) comprises a mounting plate (42) and a locating tongue (48). One end is connected to the end to the mounting plate so that the tongue extends parallel to the mounting plate. The tongue comprises a tab (54) at the end on the opposite side to the mounting plate, and a wedge portion (56) defined in the other end on the opposite side to the mounting plate, the wedge section narrowing towards the second end. The end of the mounting plate extends beyond the end of the locating tongue and is curved towards the locating tongue. The locating tongue fits in the locating notch so that the wedge section seats in the notch at the end, the tab fits in the slot, and the end of the mounting plate acts (Continued)

against the outer surface of the shell below the end of the notch to urge the tab into the slot.

10 Claims, 5 Drawing Sheets

(56) References Cited

U.S. PATENT DOCUMENTS

| | | | | |
|---|---|---|---|---|
| 4,622,700 | A * | 11/1986 | Sundahl | A42B 3/283 2/412 |
| 5,177,817 | A * | 1/1993 | Kamata | A42B 3/222 2/424 |
| D335,366 | S * | 5/1993 | Podd, III | D29/102 |
| 5,481,759 | A * | 1/1996 | Rinaldi | A42B 1/0181 2/171.1 |
| 5,898,949 | A * | 5/1999 | Barthold | A42B 3/10 2/5 |
| 6,298,497 | B1 * | 10/2001 | Chartrand | A42B 3/324 2/425 |
| 6,616,294 | B1 * | 9/2003 | Henry | F21V 21/084 2/6.2 |
| 6,811,348 | B1 * | 11/2004 | Meyer | A42B 3/04 403/324 |
| 8,510,870 | B2 * | 8/2013 | Rogers | A42B 3/324 2/418 |
| 9,357,811 | B2 * | 6/2016 | Chiang | A42B 3/14 |
| D844,255 | S * | 3/2019 | Bologna | D29/106 |
| 10,271,605 | B2 * | 4/2019 | Withnall | A42B 3/08 |
| 10,582,737 | B2 * | 3/2020 | Bologna | A42B 3/125 |
| 11,033,065 | B2 * | 6/2021 | Gotti | A42B 3/283 |
| 12,220,016 | B1 * | 2/2025 | Bologna | A42B 3/221 |
| 12,336,588 | B2 * | 6/2025 | Durocher | A42B 3/324 |
| 12,439,988 | B2 * | 10/2025 | Zimmer | A42B 3/0406 |
| 2004/0158914 | A1 * | 8/2004 | Tanaka | A42B 3/0493 2/410 |
| 2010/0005573 | A1 * | 1/2010 | Rudd | A42B 3/283 2/425 |
| 2011/0113529 | A1 | 5/2011 | Milioto | |
| 2018/0092427 | A1 * | 4/2018 | Jacobsen | A42B 3/221 |
| 2021/0244122 | A1 * | 8/2021 | O'Connell | F41H 1/04 |
| 2022/0039501 | A1 | 2/2022 | Maltz | |
| 2022/0071336 | A1 * | 3/2022 | Franzino | H02J 7/0044 |
| 2022/0378141 | A1 * | 12/2022 | Bischofberger | A42B 3/28 |
| 2023/0255301 | A1 * | 8/2023 | Levesque | A42B 3/222 2/424 |
| 2023/0320452 | A1 * | 10/2023 | Ketterer | A42B 3/30 2/422 |
| 2024/0032640 | A1 * | 2/2024 | Losos | A42B 3/324 |
| 2025/0000196 | A1 * | 1/2025 | Heinemark | A42B 3/222 |
| 2025/0089835 | A1 * | 3/2025 | Hanudel | A42B 3/326 |
| 2025/0145837 | A1 * | 5/2025 | Nakamatsu | C09D 135/02 |
| 2025/0169991 | A1 * | 5/2025 | Beckerdite | A61F 9/067 |
| 2025/0228323 | A1 * | 7/2025 | Carlson | A42B 3/06 |

FOREIGN PATENT DOCUMENTS

| | | | |
|---|---|---|---|
| CN | 113876068 | A | 1/2022 |
| CN | 1138760868 | A | 1/2022 |
| GB | 2576815 | A | 3/2020 |
| SE | 449554 | B | 5/1987 |

* cited by examiner

ARTICLE OF HEADGEAR, MOUNTING CLIPS, AND ACCESSORIES

FIELD OF THE INVENTION

This invention elates to articles of headgear having rigid shells, such as safety helmets. The invention comprises articles of headgear having locating notches for mounting accessories, locating clips for mounting in the notches, and accessories to be mounted on the articles of headgear using the locating clips.

BACKGROUND

There are numerous occasions where external accessories are fitted to safety helmets, such as lamps, identification badges, ear defenders, etc. Where these accessories are permanently fitted to the helmets, it is not possible to reconfigure the accessories for different uses. Problems can also occur if the shell of the helmet is pierced in order to attach the accessories. Even if the accessories are connected to the outside of the helmet, the use of adhesives or welding can affect the strength of the helmet and make it difficult to change the accessories.

One example of mounting an accessory on a safety helmet is described in GB2576815 where an ID card holder it attached to an outer surface of a rigid shell by ultrasonic welding.

The invention aims to provide a convenient way to attach accessories to articles of headgear, such as safety helmets, that allows difference accessories to be attached, and possibly removed, without damaging the headgear or compromising it ability to protect a wearer.

SUMMARY

A first aspect of the invention provides an article of headgear, such as a safety helmet, comprising:

a rigid shell with an outer surface having at least one locating notch defining an opening in the outer surface, wherein the notch has a first end and a second end, a base, and side walls extending from the base to the outer surface at the opening delimiting a recess behind the opening and forming a continuous surface with the outer surface of the rigid shell;

wherein:

the width of the opening decreases from the first end towards the second end;

the depth of the side walls increases from the first end towards the second end; and the width of the base decreases from the first end towards the second end and is wider at the second end than the width of the opening at the second end; and wherein the rigid shell has a slot defined in the outer surface that is aligned with the first end of the notch.

By providing the notch with the shaped form and providing a continuous surface with the outer surface of the shell, a mounting can be provided that resists accidental disconnection or rotation while maintaining the structural and protection integrity of the shell.

A second aspect of the invention provides mounting clip for use with the article of headgear, comprising:

a mounting plate having a first end and a second end; and a locating tongue having a first end and a second end, wherein the first end connected to the first end to the mounting plate so that the locating tongue extends parallel to the mounting plate;

wherein the locating tongue comprises:

a tab at the first end projecting from an opposite side to the mounting plate; and a wedge portion defined in the second end on the opposite side to the mounting plate, the wedge section narrowing towards the second end;

wherein the second end of the mounting plate extends beyond the second end of the locating tongue and is curved towards the locating tongue; and wherein the locating tongue is dimensioned to fit in the locating notch in the article of headgear so that the wedge section seats in the notch at the second end, the tab fits in the slot, and the second end of the mounting plate acts against the outer surface of the shell below the second end of the notch to urge the tab into the slot.

The base of the notch can comprise a first portion that extends from the first end and a second portion that extends from the end of the first portion to the second end of the notch at the outer surface of the rigid shell.

The rigid shell can have more than one locating notch. For example, the rigid shell can have a pair of notches in a spaced relationship at a front part of the outer surface; a notch on either side of a rear part of the outer surface; and/or a notch on opposite sides of the outer surface.

An accessory can be mounted on the rigid shell by means of the mounting clip that is fitted into the locating notch, wherein the accessory is connected to the mounting plate.

The accessory can be mounted on the rigid shell by means of a pair of mounting clips located in a respective pair of locating notches.

The invention also provides an accessory for mounting on an article of headgear, wherein the accessory is connected to the mounting plate of at least one locating clip.

Further aspects and embodiments will be apparent from the following description

DETAILED DESCRIPTION

Figure 1:
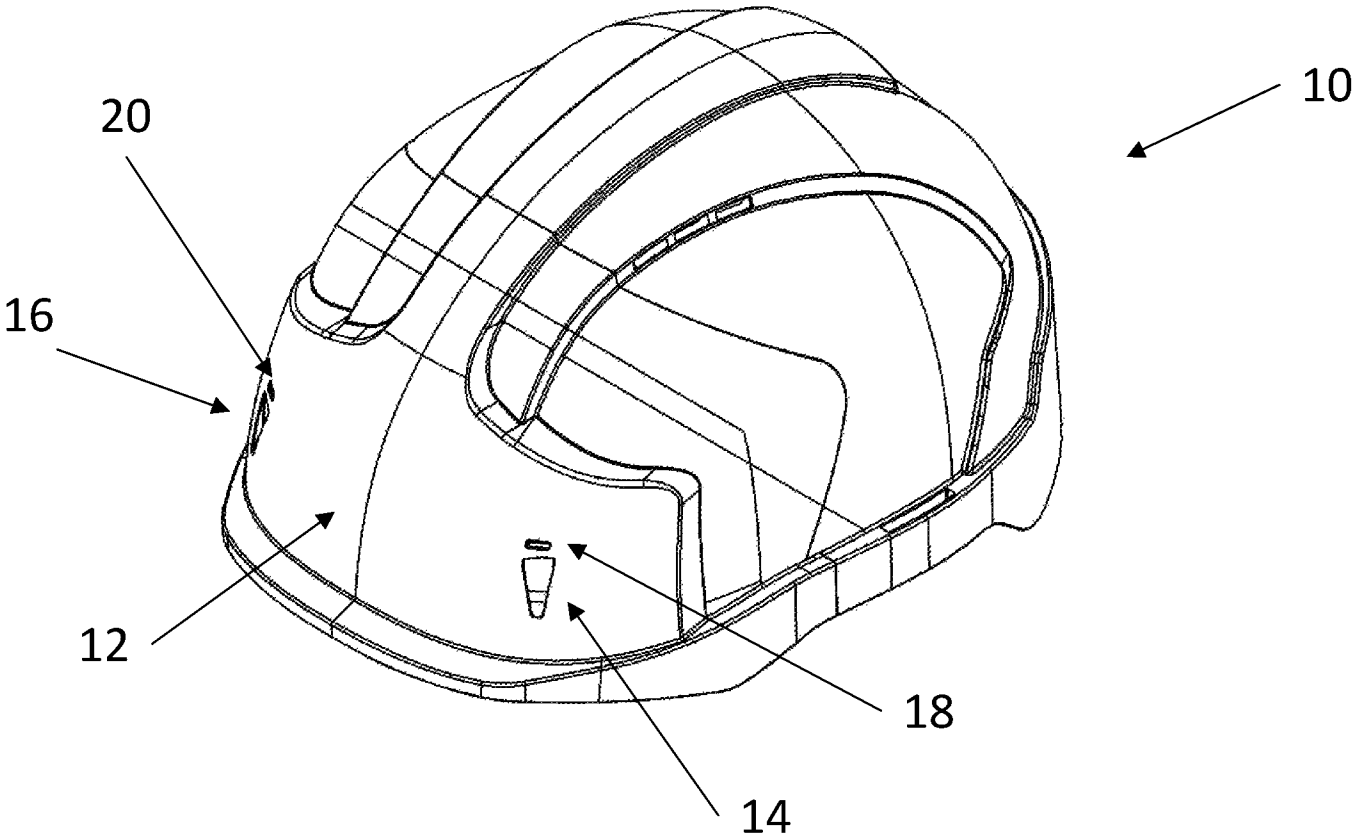
FIG. 1 shows one embodiment of the invention comprising a safety helmet.

The helmet shown in FIG. 1 comprises a shell 10 formed from a moulded plastic material. The outer surface of the shell 10 can have any appropriate colour and can carry any suitable markings. The shell 10 is substantially rigid in the sense that it does deform easily in normal use and so retains its essential form and dimensions. The shell 10 may deform temporarily or permanently under impact to provide its safety function. The helmet includes an adjustable liner and chinstrap (not shown). The front portion 12 of the shell 10 has a relatively flat region for mounting accessories.

A pair of locating notches 14, 16 is provided spaced apart on the front portion 12. A corresponding slot 18, 20 is located above each notch 16, 18. The notches 14, 16 and slots 18, 20 are respectively identical.

Figure 3:
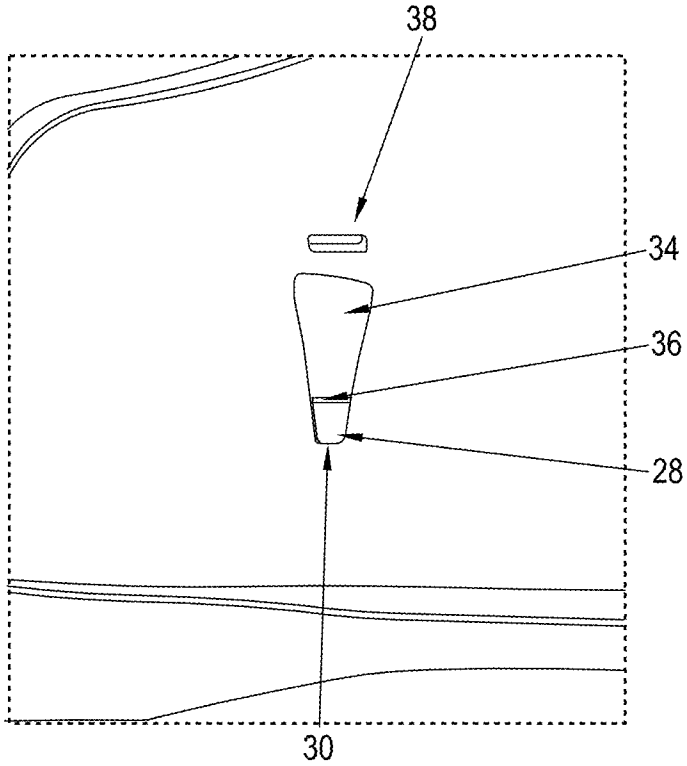
FIGS. 2 and 3 show detailed views of part of the helmet shown in FIG. 1.
Figure 2:
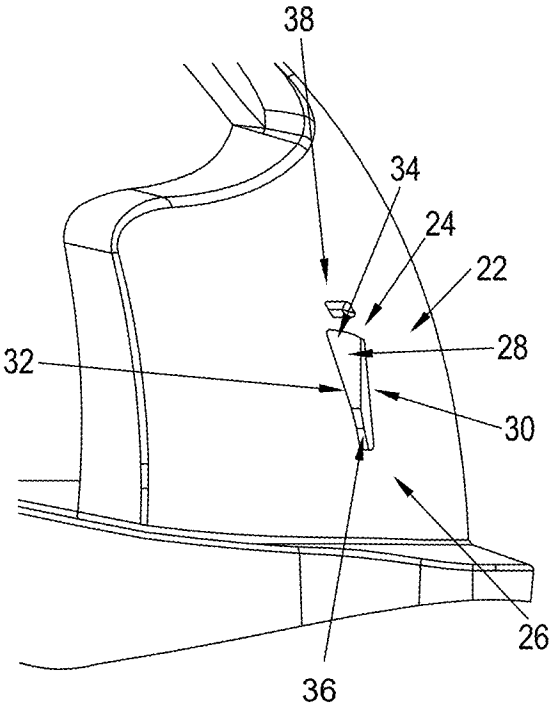

FIGS. 2 and 3 show detail of the notch 16 and slot 20 shown in FIG. 1. The notch 16 defines an opening 22 in the outer surface of the front portion 12. The notch 16 has a first, upper end 24 and a second, lower end 26. The opening 22 is wider at the first, upper end 24, tapering to the narrower second, lower end 26.

The notch 16 has a base 28 behind the opening 22, and side walls 30, 32 extending between the base and the outer surface of the front portion 12. The base 28 is inclined with respect to the outer surface of the front portion 12 such that the depth of the side walls 30, 32 increases from the first end 24, where the base connects to the outer surface, towards the second end 26. The opening 22, base 28, and side walls 30, 32 delimit a recess. The base comprises a first portion 34 that is substantially flat and extends from the first end 24 away from the outer surface, and a second portion 36 that curves up from the end of the first portion to extend to the second end of the notch 16 at the outer surface of the front portion 12.

The base 28 and side walls 30, 32 define a continuous surface with the outer surface of the front portion 12. The width of the base 28 decreases from its first end 34 towards its second end 36 and is wider at its second end 36 than the width of the opening at the second end 26.

The slot 20 is defined in the outer surface of the front portion 12. The slot 38 extends in a direction that is aligned with the width of first end 24 of the notch 16. As with the notch 16, the slot 20 forms a continuous surface with the outer surface of the front portion 12.

By providing a continuous surface in the notches 14, 16 and slots 18, 20, the integrity of the shell can be maintained. This can help avoid water ingress and maintain electrical safety performance of the helmet.

Figure 4:
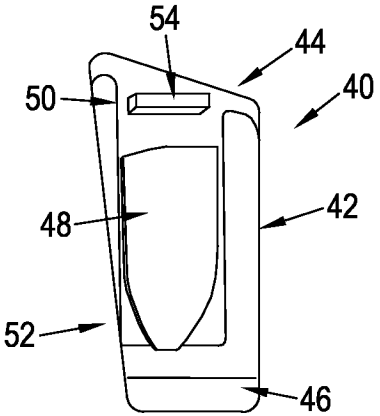
FIGS. 4 and 5 show a rear and end view of a mounting clip for use with the helmet of FIG. 1.
Figure 5:
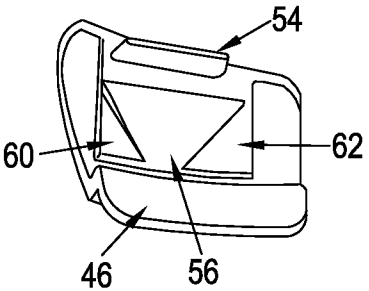

FIGS. 4 and 5 show a mounting clip 40 that can be used with the notches 14, 16 to mount an accessory on the helmet 10.

The mounting clip 40 comprises a mounting plate 42 having an upper, first end 44 and a lower, second end 46; and a locating tongue 48 having an upper, first end 50 and a lower, second end 52. The upper, first end 50 of the locating tongue 48 is connected to the upper, first end 44 of the mounting plate 42 so that the locating tongue 48 extends substantially parallel to, and behind the mounting plate 42.

The locating tongue 48 comprises a tab 54 at the first end 50 projecting from an opposite side to the mounting plate 42, and a wedge portion 56 defined in the second end 52 on the opposite side to the mounting plate 42. The wedge section 56 narrows towards the second end 52. The front face 58 of the locating tongue, i.e. the facing the mounting plate 42, has a substantially constant width to the second end 52. The parts of the front face 58 adjacent the wedge portion 56 define wings 60, 62 which project laterally on either side of the wedge portion 56.

The second end 46 of the mounting plate 42 extends beyond the second end 52 of the locating tongue 48 and is curved towards the locating tongue 48.

Figure 7:
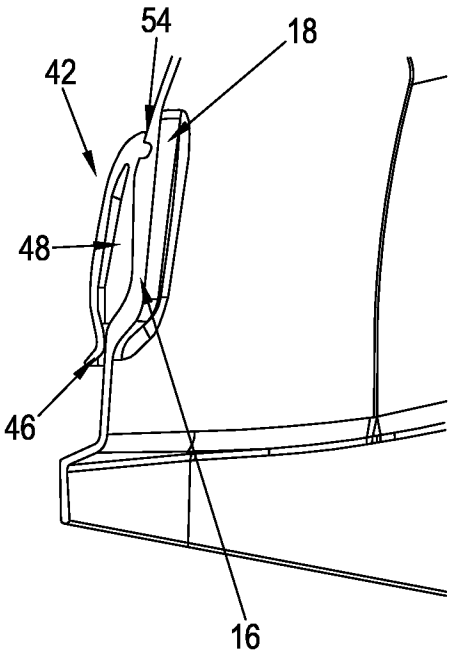
FIGS. 6 and 7 show the mounting clip of FIGS. 4 and 5 installed in the helmet of FIG. 1.
Figure 6:
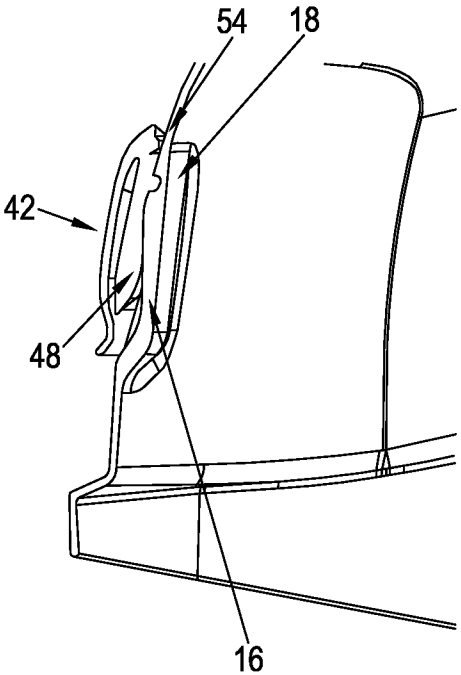

In use, the mounting clip 40 is secured to the helmet 10 by fitting the locating tongue 48 into a locating notch 14 as is shown in FIGS. 6 and 7. The second end 52 of the locating tongue 48 is inserted into the top of the notch 14 and the clip 40 is pushed down to urge the locating tongue 48 into the notch 14 until the wedge section 56 seats in the notch at the second end 26 and the wings 60, 62 sit over the outside surface 12 (FIG. 6). The tab 54 can then fit into the slot 18 (FIG. 7). The second end 46 of the mounting plate 42 acts against the outer surface 12 below the second end 26 of the notch 14 to urge the tab 54 into the slot 18 and prevent the clip 40 from moving upwards to disengage the locating tongue 48 from the notch 14. The base 28 of the notch 14 prevents the locating tongue 48 from dropping lower, and the wedge portion 56 and wings 60, 62 engage in the lower end 26 of the notch 14 to prevent the locating tongue 48 from disengaging through the front of the opening 22.

The material of the clip 40 is sufficiently flexible that the lower ends 46, 52 of the mounting plate 42 and locating tongue 48 can be forced apart so that the locating tongue can be forced into the notch, and sufficiently resilient to urge the tab 54 into the slot 18. In some embodiments, the clip can be made of a rubber-like material so that is can be installed and remove manually by simply distorting the clip sufficiently to engage or disengage the relevant parts. In other embodiments, a more rigid material can be used that requires the use of a fitting tool to ensure the correct degree of distortion for installation or removal. In a further embodiment, the material is too stiff to be distorted for removal without breaking the structure of the clip. This allows for a more permanent installation.

Figure 8:
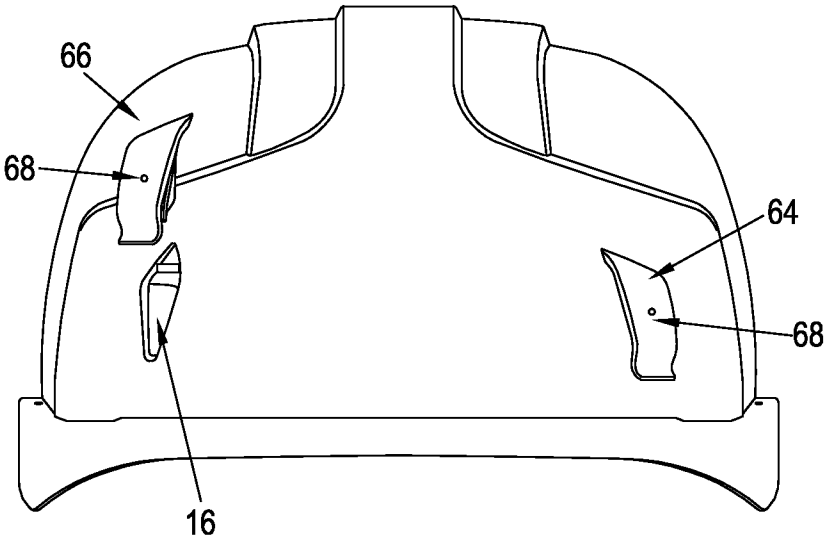
FIG. 8 shows a helmet with one mounting clip installed and another mounting clip positioned prior to installation.
Figure 11:
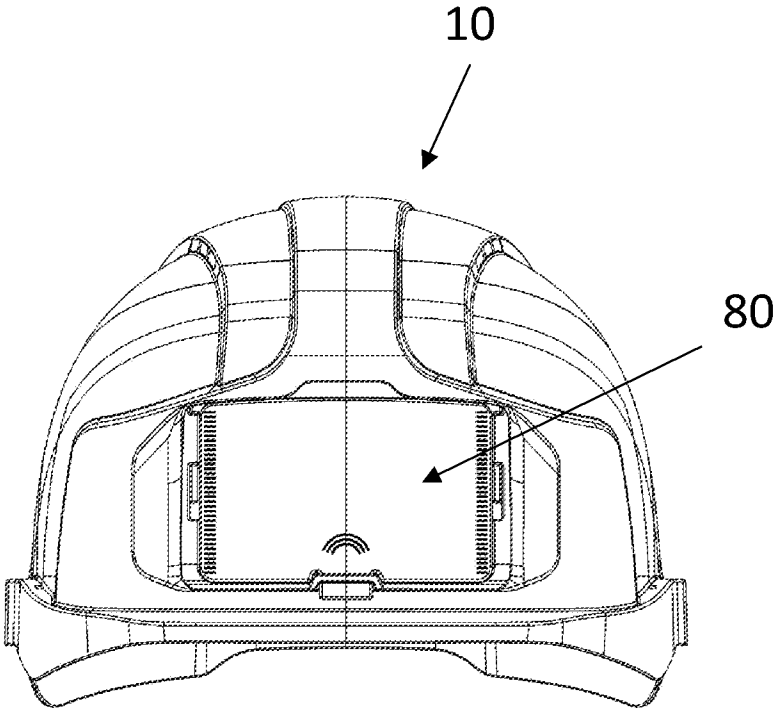
FIG. 11 shows a badge holder located on the helmet.

FIG. 8 shows a helmet with one mounting clip 64 installed and another mounting clip 66 positioned prior to installation. The mounting plate of each clip 64, 66 has a locating hole 68 by which the clip can be connected to an accessory for mounting on the helmet.

Figure 9:
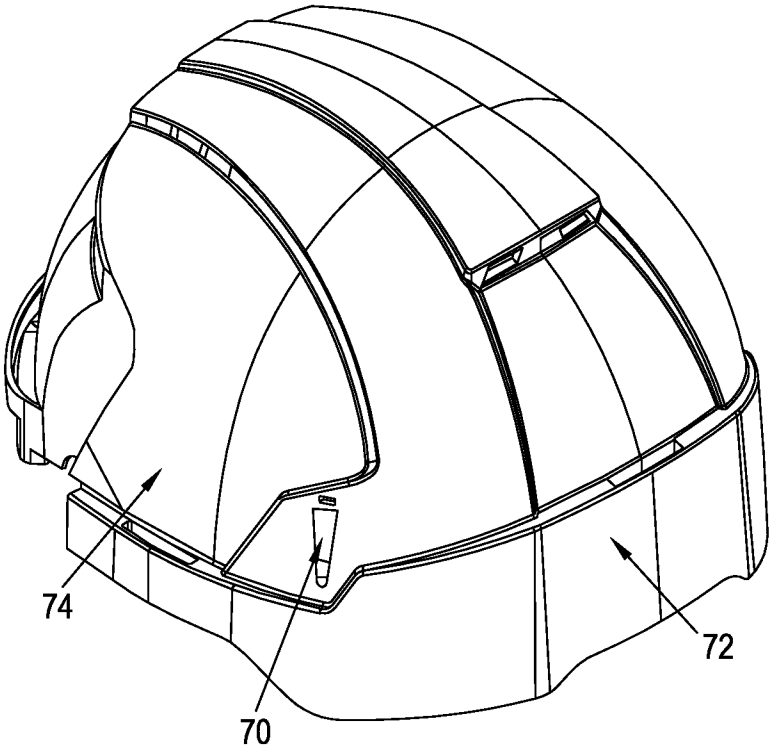
FIG. 9 shows a rear part of another embodiment of a helmet.

The notches can be located at any suitable position on the helmet. FIG. 9 shows another embodiment of the helmet in which notches 70 (only one shown) are positioned on either side of a rear part 72 of the helmet 10. Notches (not shown) can also be provided in the sides 74 of the helmet over the position where a wearer's ears would be located in use. Any number and combination of positions can be provided according to requirements.

Figure 10:
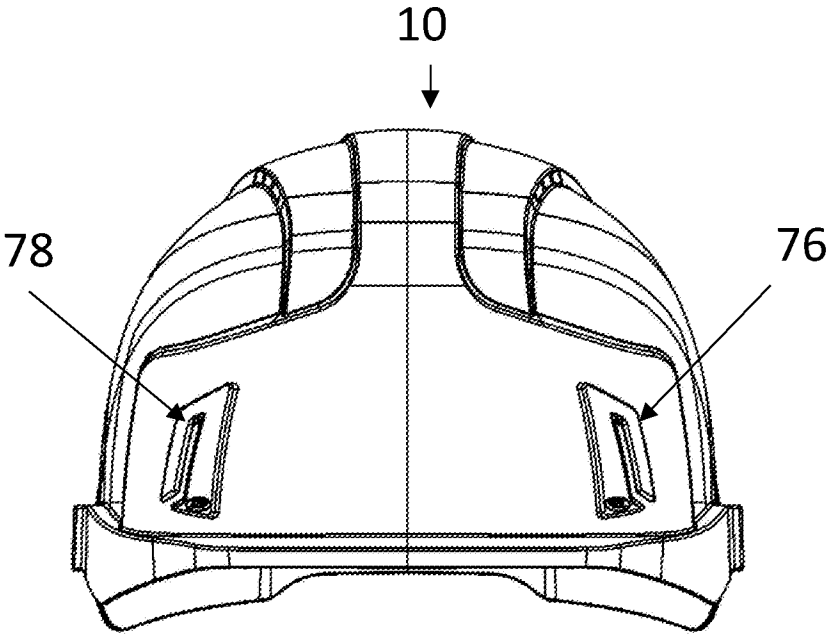
FIG. 10 shows a pair of lamp clips located on the helmet.

FIG. 10 shows a pair of lamp clips 76, 78 located on the helmet 10 by means of mounting clips engaged in notches. The lamp clips 76, 78 allow a lamp (not shown) to be mounted on the front of the helmet 10 so that it can be easily removed when not in use. FIG. 10 shows an ID badge holder 80 mounted on the front of the helmet 10 by means of mounting clips (not shown) connected to a rear surface of the holder 80.

Various changes can be made within the scope of the invention.

The invention claimed is:

1. An article of headgear, comprising:

a rigid shell with an outer surface having at least one locating notch defining an opening in the outer surface, wherein the notch has a first end and a second end, a base, and side walls extending from the base to the outer surface at the opening delimiting a recess behind the opening and forming a continuous surface with the outer surface of the rigid shell;

wherein:

the width of the opening decreases from the first end towards the second end;

the depth of the side walls increases from the first end towards the second end; and the width of the base decreases from the first end towards the second end and is wider at the second end than the width of the opening at the second end; and wherein the rigid shell has a slot defined in the outer surface that is aligned with the first end of the notch.

2. The article of headgear as claimed in claim 1, wherein the base of the notch comprises a first portion that extends from the first end of the notch and a second portion that extends from an end of the first portion to the second end of the notch at the outer surface of the rigid shell.

3. The article of headgear as claimed in claim 1, wherein the rigid shell has more than one locating notch.

4. The article of headgear as claimed in claim 3, wherein the rigid shell has a pair of notches in a spaced relationship at a front part of the outer surface.

5. The article of headgear as claimed in claim 3, wherein the rigid shell has a notch on either side of a rear part of the outer surface.

6. The article of headgear as claimed in claim 3, wherein the rigid shell has a notch on opposite sides of the outer surface.

7. A mounting clip for use with an article of headgear as claimed in claim 1, comprising:

a mounting plate having a first end and a second end; and a locating tongue having a first end and a second end, wherein the first end of the locating tongue is connected to the first end to the mounting plate so that the locating tongue extends parallel to the mounting plate;

wherein the locating tongue comprises:

a tab at the first end of the locating tongue projecting from an opposite side to the mounting plate; and a wedge portion defined in the second end of the locating tongue on the opposite side of the locating tongue to the mounting plate, the wedge portion narrowing towards the second end of the locating tongue;

wherein the second end of the mounting plate extends beyond the second end of the locating tongue and is curved towards the locating tongue; and wherein the locating tongue is dimensioned to fit in the locating notch in the article of headgear so that the wedge section seats in the notch at the second end of the notch, the tab fits in the slot, and the second end of the mounting plate acts against the outer surface of the shell below the second end of the notch to urge the tab into the slot.

8. The article of headgear as claimed in claim 1, comprising an accessory mounted on the rigid shell by means of a mounting clip that is at least partially inserted into the locating notch, wherein the accessory is connected to the mounting clip.

9. The article of headgear as claimed in claim 8, wherein the accessory is mounted on the rigid shell by means of a pair of mounting clips located in a respective pair of locating notches.

10. An accessory for mounting on an article of headgear as claimed in claim 1, wherein the accessory is connected to a mounting plate of at least one locating clip.

* * * * *